United States Patent [19]

Brucken et al.

[11] 4,347,046

[45] Aug. 31, 1982

[54] SWASH PLATE COMPRESSOR

[75] Inventors: Byron L. Brucken, Miamisburg; Frank W. Hodits, Jr., Kettering, both of Ohio

[73] Assignee: General Motors Corporation, Detroit, Mich.

[21] Appl. No.: 186,749

[22] Filed: Sep. 12, 1980

Related U.S. Application Data

[63] Continuation-in-part of Ser. No. 966,067, Dec. 4, 1978, abandoned.

[51] Int. Cl.[3] ..... F04B 1/16; F04B 1/18; F04B 39/16

[52] U.S. Cl. ..... 417/269; 92/79

[58] Field of Search ..... 417/269, 902; 92/79

[56] References Cited

U.S. PATENT DOCUMENTS

| | | | |
|---|---|---|---|
| 2,124,239 | 7/1938 | Smith | 417/902 |
| 2,787,136 | 4/1957 | Wurtz | 417/902 |
| 3,552,886 | 1/1971 | Olson, Jr. | 417/269 |
| 3,746,475 | 7/1973 | Johnson | 417/269 |
| 3,749,523 | 7/1973 | Wahl, Jr. | 417/269 |
| 3,888,604 | 6/1975 | Oshima et al. | 417/269 |
| 3,904,320 | 9/1975 | Kishi et al. | 417/269 |
| 3,930,758 | 1/1976 | Park | 417/269 |
| 3,981,629 | 9/1976 | Nakayama | 417/269 |
| 3,999,893 | 12/1976 | Kishi | 417/269 |
| 4,101,249 | 7/1978 | Nakayama et al. | 417/269 |
| 4,135,862 | 1/1979 | Degawa | 417/269 |

FOREIGN PATENT DOCUMENTS 2109616 10/1971 Fed. Rep. of Germany ..... 417/269

*Primary Examiner*—William L. Freeh
*Attorney, Agent, or Firm*—R. L. Phillips

[57] ABSTRACT

A swash plate compressor of light weight construction having a cylinder block defining weight reducing tubular cylinder bore portions which form, with its outer shell, a low pressure gas upper inlet channel and a pair of low pressure gas lower exit channels. Aperture means are provided in one of the heads and its associated valve plate to allow direct axial flow communication from the compressor suction inlet to the upper inlet channel for receiving a mixture of low pressure gas and oil. Aperture means are formed in the compressor heads and their associated valve plates providing communication from the upper inlet channel to the compressor low pressure gas suction chambers via a weight reducing swash plate space that completely exposed the swash plate and each of the lower exit channels. The result is that compressor weight is reduced while lubrication is achieved by the low pressure gas and oil mixture entering the upper inlet channel and flowing in heat exchange relation with the upper tubular portions separating a portion of the oil from gas for deposit on the upper tubular portions for subsequent gravitational flow to the operation portions of the compressor and with the low pressure gas and oil mixture directly exposed to and enveloping the swash plate to ensure that sufficient entrained oil is caused to separate out as a film on the swash plate sides.

7 Claims, 23 Drawing Figures

374R
239
370F
236
240
372R
374F
376
240
376
370R
244
372F 299
231A
210
221
296
312F
272
358F
314F
312F
316F
232F(A)
232F(B)
316F
271
324
320
270
295
315F
278
234F
270
356F
300
305F
304
357F
303
231B
321
306F
354F
316F
312F
222
278
314F
223
224
214
359F
212
242
241
277
248
260
262
248
252R
249
242
268
242
248
242
248
230
232R(A)
285
234R
220
314R
314R
232R(B)
284
312R
318R
366R
219
280
231A
332
305R
301
320
250R
219
316R
256
350(B)
234R
340
315R
308
306R
350
309
355R(C)
229
357R
218
339
315R
359R
232R(C)
216
231B
314R
316R
228
219
318R
356R
227
312R
317R
226
225

SWASH PLATE COMPRESSOR

This application is a continuation-in-part of copending application Ser. No. 966,067, filed Dec. 4, 1978, now abandoned.

This invention relates to refrigerant compressors and more particularly to an improved compact swash plate compressor for air conditioning applications.

It has become an ever increasing requirement in mobile air conditioning systems for improved compressors which are reduced in size and weight to enable vehicles to achieve higher fuel efficiency. An example of a successful compressor presently used in automotive air conditioning systems is disclosed in U.S. Pat. No. 3,057,545 to Ransom, et al, issued Oct. 10, 1962 and assigned to the assignee of the present application. The Ransom et al swash plate compressor, which is referred to as an axial six compressor in that it has three double acting axial reciprocating pistons, is an efficient reliable apparatus but it requires a separate oil pump for its lubrication system. Numerous attempts have been made to provide axial swash plate compressors with improved lubricating systems which eliminate an oil pump. An example of such a compressor is disclosed in U.S. Pat. No. 3,930,758 to Kwang H. Park, issued Jan. 6, 1976, also assigned to General Motors Corporation.

Accordingly, it is an object of the present invention to provide an improved small swash plate compressor suitable for use in automotive air conditioning systems having a minimum number of parts.

It is another object of the present invention to provide an improved compact swash plate compressor of light weight having a lubrication system which does not require a separate oil pump.

It is still another object of the present invention to provide an improved open-deck swash plate compressor, i.e. open space between adjacent cylinder tubular portions, which achieves a substantial reduction in weight.

Still another object of the present invention is to provide an improved axial swash plate compressor in which lubrication is achieved by a refrigerant flow path wherein the flow of low pressure refrigerant gas from an inlet in one end of the compressor, containing a substantial amount of entrained oil, enters a longitudinally extending inlet channel means defined by the open-deck at a high elevation in the compressor such that the refrigerant gas and oil mixture is conveyed in heat exchange relation with an upper portion of the cylinder block structure increasing the temperature of the gas causing sufficient oil to separate therefrom and deposit on the upper tubular cylinder block portions for subsequent gravitational flow to lubricate portions of the compressor, and whereby flow of low pressure refrigerant gas is also caused to exit the upper inlet channel for delivery to a swash plate central space prior to being conveyed to the compressor's cylinders by one or more longitudinally extending inlet channels at a low elevation in the compressor thereby allowing oil mixed with the gas to envelope and impinge upon and wet the surfaces of the swash plate mechanism to ensure lubrication of same during operation of the compressor.

Further objects and advantages of the present invention will be apparent from the following description, reference being had to the accompanying drawings wherein two embodiments of the present invention are clearly shown.

Figure 1:
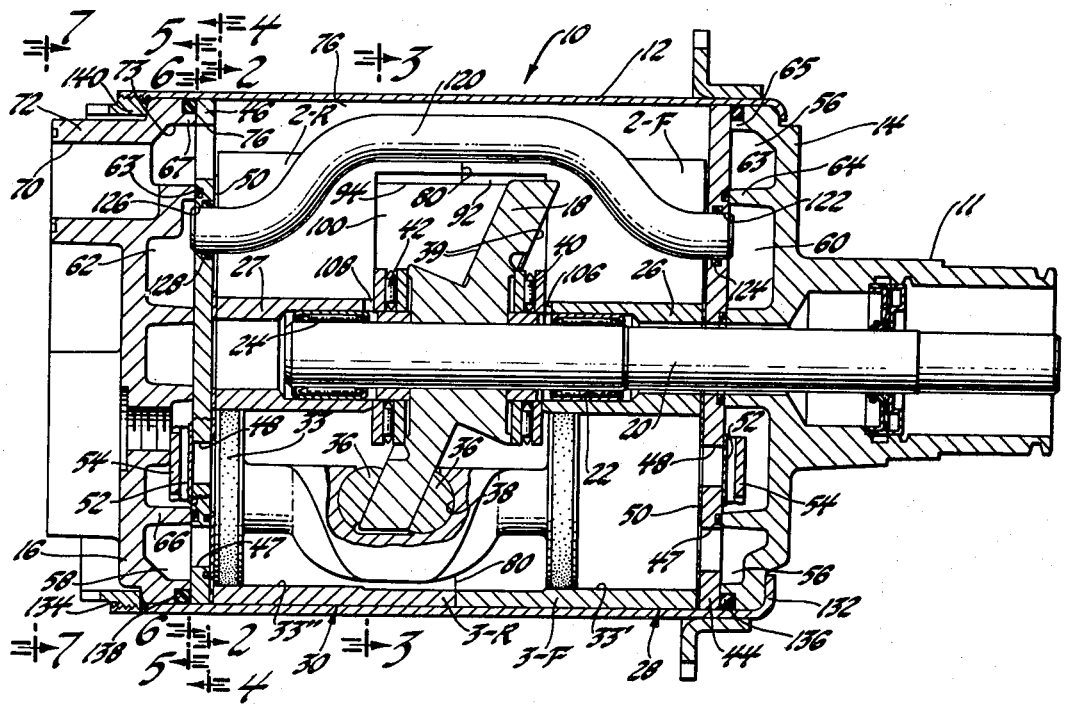
FIG. 1 is a vertical sectional view of one embodiment of the improved swash plate compressor of the present invention.

Referring now to the drawings wherein two embodiments of the present invention have been disclosed and first with respect to the embodiment in FIGS. 1–7, reference numeral 10 in FIG. 1 designates a swash plate axial compressor which is adapted to be driven by suitable drive means, such as a magnetic clutch assembly (not shown) suitably mounted on neck portion 11.

Reference numeral 12 designates an outer shell element which is cylindrical in shape and serves to support a pair of front and rear cylinder heads 14 and 16 respectively which close the opposite ends of the shell 12 as shown. A swash plate 18 is fixedly mounted on a compressor drive shaft 20 which shaft is rotatably supported by front 22 and rear 24 journal bearings mounted in the front 26 and rear 27 central hub portions integrally formed with front 28 and rear 30 cylinder blocks, respectively. Rotation of the drive shaft 20 is transformed into reciprocal motion of three double-acting pistons indicated at 31, 32 and 33 in FIG. 2. As seen by lower double-acting piston 33 in FIG. 1, each of the pistons are arranged to reciprocate in a direction parallel to the axis of the drive shaft by means of being slidably disposed in opposed front 31', 32', 33' and rear 31'', 32'' 33'' piston cylinder bores of the front 28 and rear 30 cylinder blocks, respectively.

The rotation of the drive shaft 20 is transformed into reciprocal motion of the double acting pistons 31, 32 and 33 through sliding members which in the disclosed form are half-sphere bodies 36. As seen in FIG. 1 for piston 33 each of the pistons has a central part of its one side cut-away so as to straddle the outer edge of the swash plate 18. Bowl-shaped recesses 38 are formed on the cut-away portions of the pistons with the half-sphere sliding bodies 36 journaled within the bowl-shaped recesses 38 in opposed relation with the flat sides of the bodies cooperating with the planar surfaces 39 of intermediate swash plate 18. By virtue of the bearing construction shown in FIG. 1, the piston pumping loads are taken both by the front 22 and rear 24 radial or journal needle bearings and front 40 and rear 42 needle thrust bearings.

Figure 4:
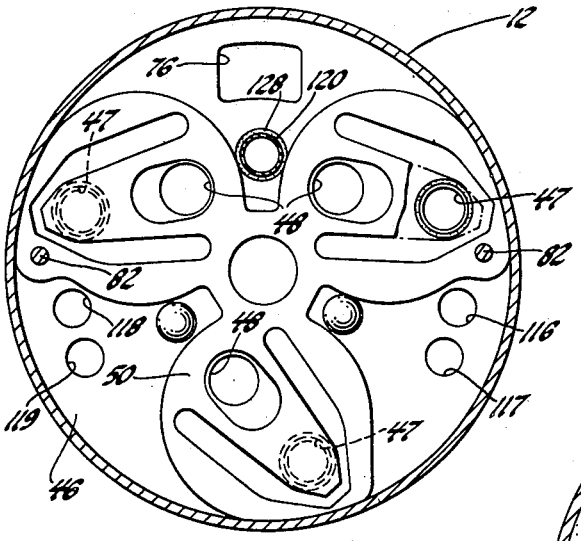
FIG. 4 is a vertical sectional view taken on the line 4—4 of FIG. 1, showing the rear valve plate and suction outlet reed valve of the compressor.
Figure 5:
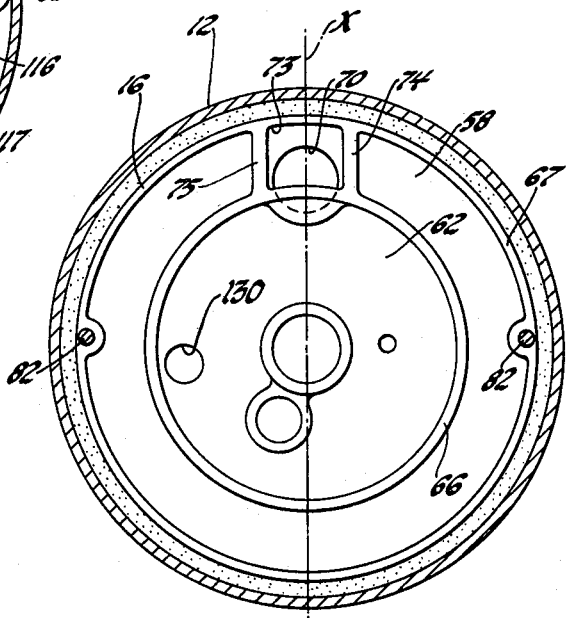
FIG. 5 is a vertical sectional view taken substantially on the line 5—5 of FIG. 1, showing the inner face of the compressor rear head.
Figure 6:
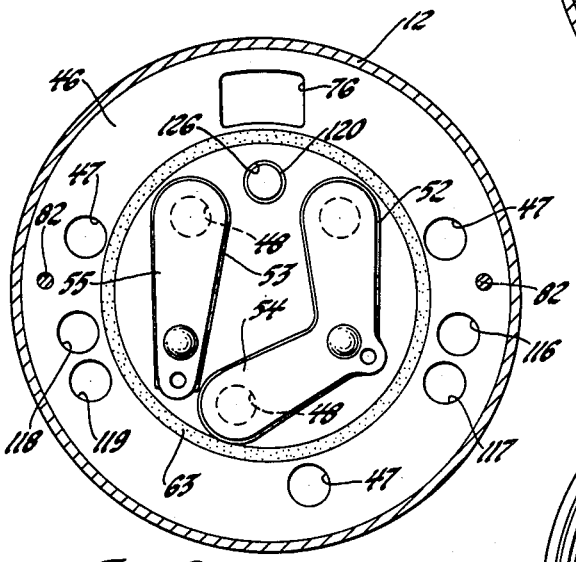
FIG. 6 is a vertical sectional view taken substantially on the line 6—6 of FIG. 1, showing the discharge valve arrangement of the subject compressor.
Figure 7:
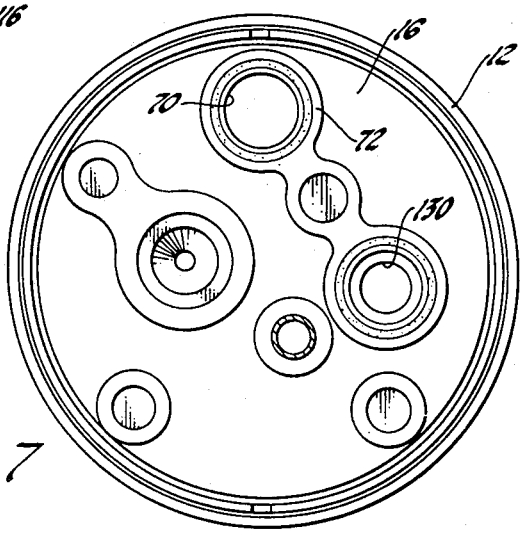
FIG. 7 is an elevational end view taken on line 7—7 of FIG. 1, showing the rear head of the compressor.

Individual front 44 and rear 46 valve plates are mounted between the front 14 and rear 16 heads and their associated front 28 and rear 30 cylinder blocks. As seen in FIGS. 1 and 4, the valve plates 44, 46 are formed with suction inlet and discharge outlet ports 47 and 48 respectively, in registry with each front 31', 32', 33' and rear 31'', 32'', 33'' cylinder. Each valve plate is provided with a suction reed valve 50 on its inner face and discharge reed valves 52 and 53 (FIG. 6) on its outer face as is well known in the prior art. Backup valve retainers or stops 54 and 55 are provided for their associated discharge reed valves 52 and 53 respectively, to prevent excessive deflection thereof. Each suction inlet port 47 provides communication between its associated pumping cylinder bore and front 56 and rear 58 head outer low pressure gas suction cylindrical chambers, as seen at 58 in FIG. 5 for the rear head 16 outer suction chamber. Each discharge or outlet port 48 provides communication between the pumping cylinder bores and the front 60 and rear 62 head high pressure gas inner discharge chambers, as seen in FIG. 5 for the rear head inner chamber 62. It will be noted that O-ring seals 63 in the front and rear valve plates separate the outer suction chambers 56, 58 from the inner discharge chambers 60, 62 respectively.

The front and rear cylinder heads 14 and 16 each have intermediate and outer concentric closed annular loops or ribs 64, 65 and 66, 67 respectively, defining the front 56 and rear 58 head low pressure outer suction chambers which communicate with their associated three suction gas inlet ports 47. As seen in FIG. 5, the rear head 16 has a circular suction gas upper inlet bore or opening 70, symmetrical with the vertically extending plane defined by construction line "X" of FIG. 5. The opening 70 extends through integral boss 72, communicating first with a near rectangular shaped aperture 73, defined between the intermediate 66 and outer 67 annular ribs and vertical interconnecting partitions 74 and 75 positioned in parallel equidistant relation on either side of the construction line "X". Rear valve plate 46 includes an upper opening 76 shaped to align with the near rectangular shaped aperture 73. Thus, the suction gas to be compressed is admitted, via aligned rear head inlet opening 70, rear valve plate opening 76 and aperture 73, into a lower pressure refrigerant gas upper inlet channel or suction passage 77.

Figure 2:
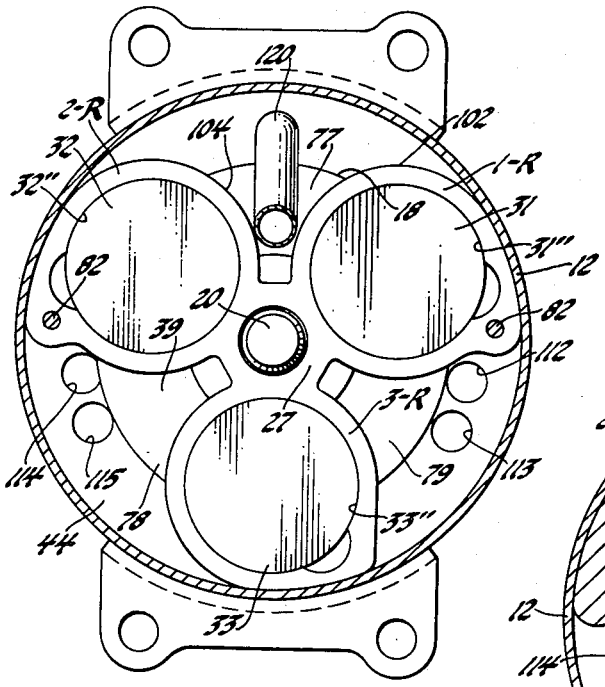
FIG. 2 is a vertical sectional view of the compressor taken substantially on the line 2—2 of FIG. 1, showing the rear face of the piston cylinder block.
Figure 3:
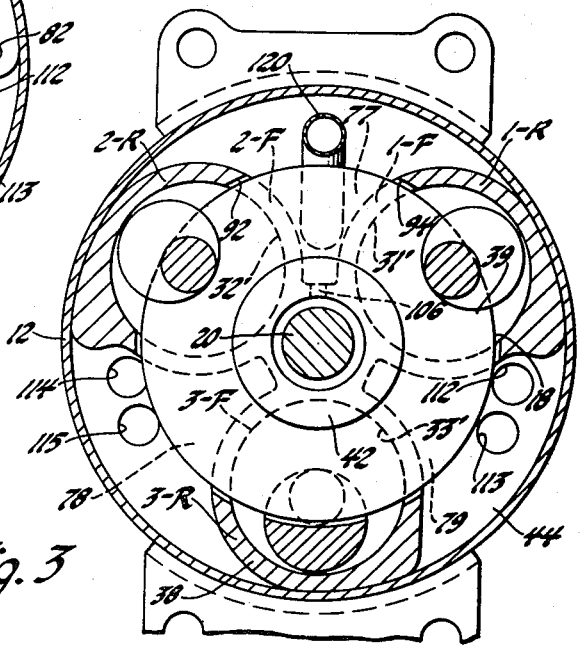
FIG. 3 is a vertical sectional view of the compressor taken substantially on the line 3—3 of FIG. 1, showing the notched-out portions of the rear cylinder block.

As best seen in FIGS. 1 and 3, the front 28 and rear 30 cylinder blocks are located in flush aligned engagement by a pair of alignment or locating pins (not shown) along a transverse parting surface indicated at 80 in FIG. 1. Similar pairs of alignment pins, shown at 82 in FIGS. 2, 4 and 5, properly locate the valve plates and compressor heads by insertion in locating holes. Thus, the inlet channel 77 is formed by the front cylinder block 28 upper tubular portions 1-F and 2-F, the corresponding abutting rear cylinder block tubular portions 1-R and 2-R (FIG. 3) defining, with the outer shell 12, the low pressure refrigerant gas upper inlet channel 77. In a similar manner the front 1-F and rear 1-R pair of upper tubular portions define with the front 3-F and rear 3-R pair of lower tubular portions and the shell 12, a first low pressure refrigerant gas lower exit channel or suction passage 78. Lastly, the front 2-F and rear 2-R pair of upper tubular portions define, with the front 3-F and rear 3-R pair of lower tubular portions and the shell 12, a second low pressure refrigerant gas exit channel or suction passage 79.

Each of the front and rear opposed tubular portions of the cylinder blocks has its pair of front and rear cylinder bores axially separated in part by a substantially one-half or semi-cylindrical radially inwardly-facing notched-out opening or cavity. Thus, as seen in FIG. 1, the front upper tubular portion 2-F has an inner notched-out portion 92 in mirror image relation to the notched-out portion 94 of the rear upper tubular portion 1-R. In this manner the three one-half cylindrical notched-out openings of the opposed tubular portions 1-F, 1-R; 2-F, 2-R; and 3-F, 3-R together with the opposed inner faces of the front 26 and rear 27 hubs define a central swash-plate accommodating space 100.

Thus, in operation the total flow of relatively low pressure, low temperature suction gas entering the rearward end of the upper inlet channel, containing a substantial amount of oil in suspension, flows axially in heat exchange relation over the heated upper surfaces 102 and 104 of the upper tubular portions 1-R, 1-F, 2-R and 2-F. The increased temperature of the refrigerant gas causes a portion of the entrained oil to separate from the gas and deposit by gravity on the upper tubular portions. The lubricant or oil collected on the surfaces 102, 104 is subjected to the heat of the compressor cylinder blocks and the refrigerant dissolved therein is driven-off or "flashes-off" by this heat. The substantially refrigerant-free lubricant or oil thus deposited subsequently moves by gravitational flow downwardly via slot means 106 and 108 on the front and rear hub inner faces to lubricate the front 22 and rear 24 journal means, and front 40 and rear 42 thrust bearing means.

Further, the total flow of low pressure refrigerant gas is caused to exit the upper inlet channel 77 via the upper tubular portion notched-out openings 92, 94 (FIG. 3) for delivery or flow to the swash-plate central space 100 prior to being drawn or conveyed into the pair of lower exit channels 78 and 79. The result is that sufficient of the remaining oil admixed with the gas impinges upon and wets or "fogs" the surfaces 39 of the swash plate 18 to provide lubrication between the swash plate and the half-sphere shoes or bodies 36 during reciprocation of the dual-acting pistons 31, 32 and 33.

As best seen in FIGS. 2 and 3, lower channel outlet means are provided on the front 44 and rear 46 valve plates. In the form disclosed the outlet means are pairs or sets of holes 112, 113 and 114, 115 in the front valve plate 44 and pairs or sets of holds 116, 117 and 118, 119 in the rear valve plate 46. By means of these paired holes, aligned with their associated lower exit channel, the total flow low presure gas flows from the swash plate space 100 and divides into the two lower exit channels 78 and 79. As seen in FIG. 4 for rear valve plate paired holes 116, 117 and 118, 119, the holes are aligned into each of their associated lower exit channels 79 and 78 respectively to provide communication to both the front and rear head outer suction annular chambers 56 and 58 for introduction of the gas into their associated front and rear cylinder bores.

The compressed gas is discharged into both the front and rear cylinder head central discharge chambers 60 and 62. Thereafter the discharge chambers are connected by means of a discharge gas crossover tube 120, the front end of which is telescoped in opening 122 in the front valve plate and sealed by O-ring 124. In a similar manner the rear end of tube 120 is telescoped in opening 126 in the rear valve plate and sealed by O-ring 128. Thus, the compressed refrigerant gas travels from front chamber 60 via tube 120 into rear chamber 62 and leaves the compressor through a rear head outlet aperture 130.

In the form shown the compressor is assembled by forming the outer shell front end with a rolled front edge 132 such that the sub-assembly of the compressor heads, blocks, valve, plates, etc. is telescopically received in the open threaded end 134 of the shell. The assembly is then closed in a sealed manner by front and rear head O-rings 136 and 138 and torqued together by ring nut 140.

Another achievement of applicants' unique compressor is in its substantial reduction in weight over prior art axial compressors. The arrangement provides cylinder heads 14 and 16 which partially form the pair of radially outer suction cavities or chambers 56, 58 and the pair of radially inner discharge cavities or chambers 60, 62 flanking the compressor crankcase formed by shell 12. The front 28 and rear 30 cylinder blocks and their associated three composite tubular portions define a composite trifurcated cylinder block including three tubular portions arranged about an axis to provide open space between adjacent pairs of the tubular portions, thereby to reduce the weight of said cylinder block.

Figure 8:
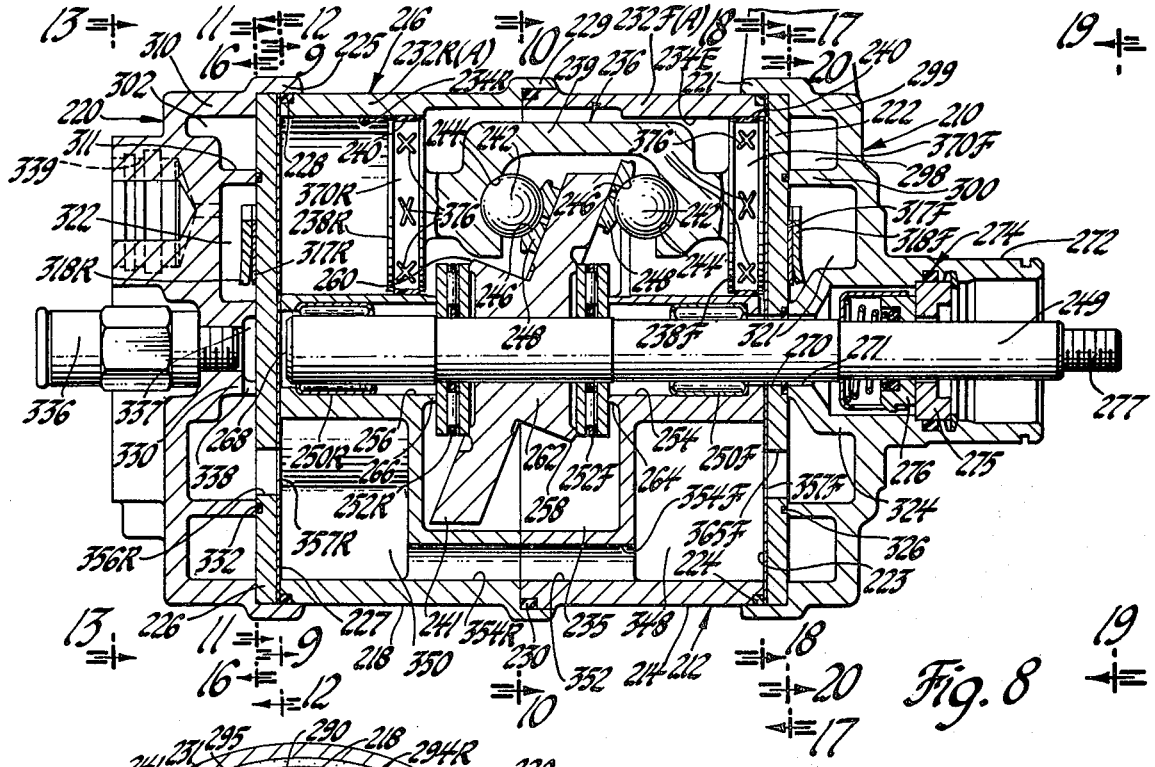
FIG. 8 is a longitudinal sectional view taken along the line 8—8 in FIG. 9 of another or alternative embodiment of the improved swash plate compressor of the present invention.
Figure 21:
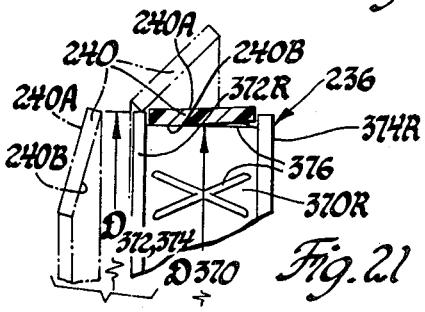
FIG. 21 is an enlarged partial view of one of the piston heads in FIG. 18 showing the assembly of the ring thereon.
Figures 22, 23:
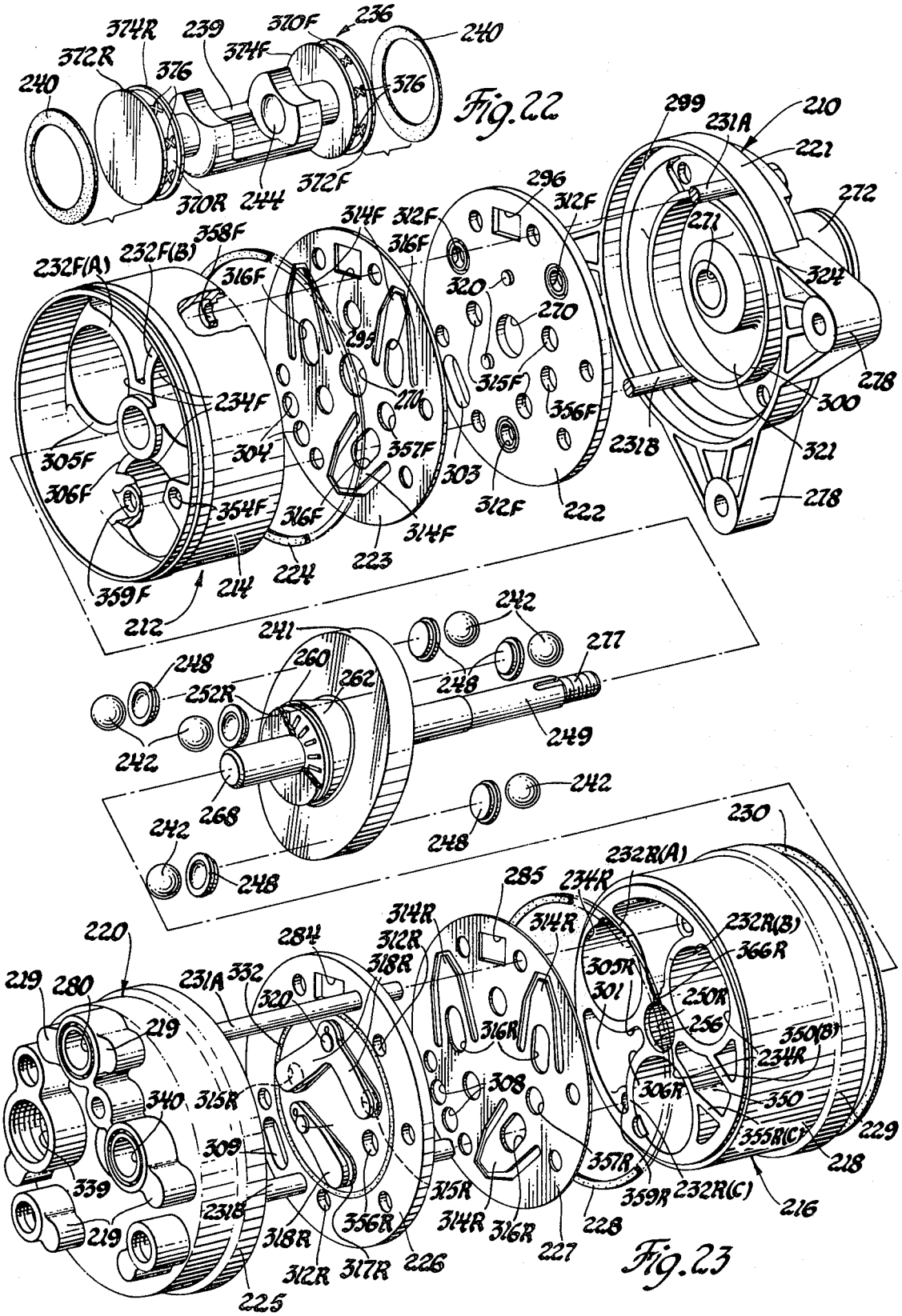
FIG. 22 is an exploded view of one of the pistons and its rings from the refrigerant compressor in FIG. 8.
FIG. 23 is an exploded view of the refrigerant compressor in FIG. 8 excluding the pistons.

The other or preferred embodiment of the present invention shown in FIGS. 8–23 is utilized to advantage in an integral shell and cylinder block form of compressor construction comprising a plurality of die cast aluminum parts; namely, a front head 210, a front cylinder block 212 with integral cylindrical case or shell 214, a rear cylinder block 216 with integral cylindrical case or shell 218 and a rear head 220. As can be seen in FIGS. 8 and 23, the front head 210 has a cylindrical collar 221 which telescopically fits over the front end of the front cylinder block shell 214 with both a rigid circular front valve plate 222 of steel and a circular front valve disk 223 of spring steel sandwiched therebetween and with an O-ring seal 224 provided at their common juncture. Similarly, the rear head 220 has a cylindrical collar 225 which telescopically fits over the rear end of the rear cylinder block shell 218 with both a rigid circular rear valve plate 226 of steel and a circular rear valve disk 227 of spring steel sandwiched therebetween and with an O-ring seal 228 providing sealing at their common juncture. Then at the juncture of the cylinder blocks, the rear cylinder block shell 218 has a cylindrical collar 229 at its front end which telescopically fits over the rear end of the front cylinder block shell 214 and there is provided an O-ring seal 230 to seal this joint in the transversely split two-piece cylinder block thus formed.

All the above metal parts are clamped together and held by six (6) bolts 231 at final assembly after the assembly therein of the internal compressor parts later described. The bolts 231 extend through aligned holes in the front head 210, valve plates 222, 226 and valve disks 223, 227 and either alignment bores and/or passages in the cylinder blocks 212, 216 (as described in more detail later) and are threaded to bosses 219 formed on the rear head 220. The heads 210 and 220 and cylinder block shells 214 and 218 have generally cylindrical profiles and cooperately provide the compressor with a generally cylindrical profile or outline of compact size characterized by its short length as permitted by the piston and piston ring structure described in detail later.

Figure 9:
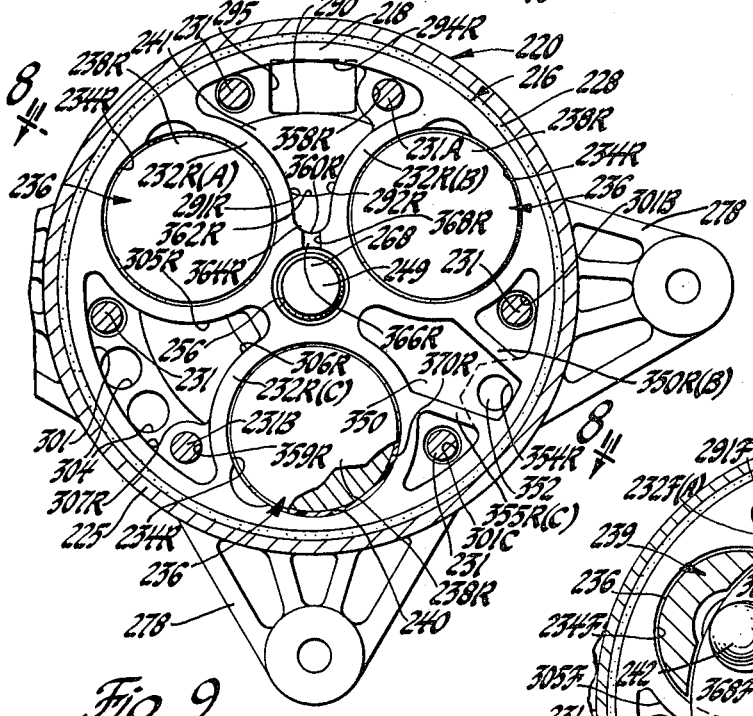
FIG. 9 is a view taken along the line 9—9 in FIG. 8 with the upper two cylinder bores oriented parallel to each other.
Figure 10:
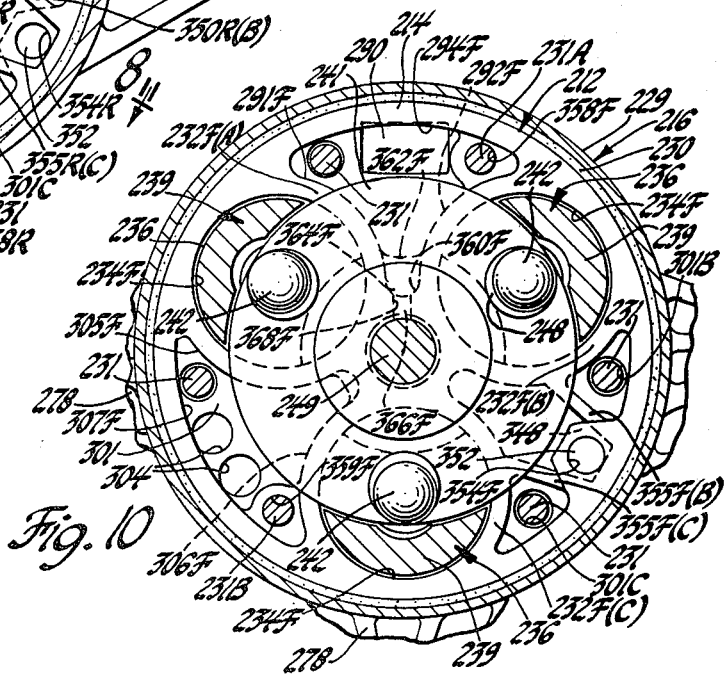
FIG. 10 is a view oriented like FIG. 9 and taken along the line 10—10 in FIG. 9.
Figure 11:
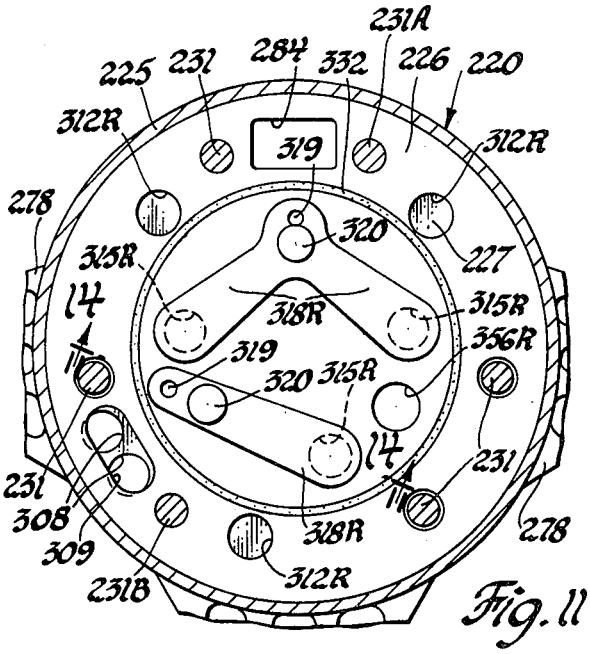
FIG. 11 is a view oriented like FIG. 9 and taken along the line 11—11 in FIG. 8.
Figure 12:
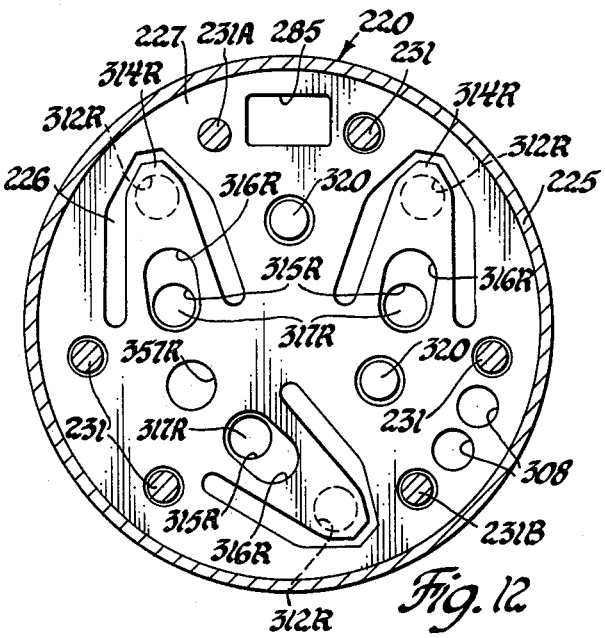
FIG. 12 is a view oriented like FIG. 9 and taken along the line 12—12 in FIG. 9.
Figure 13:
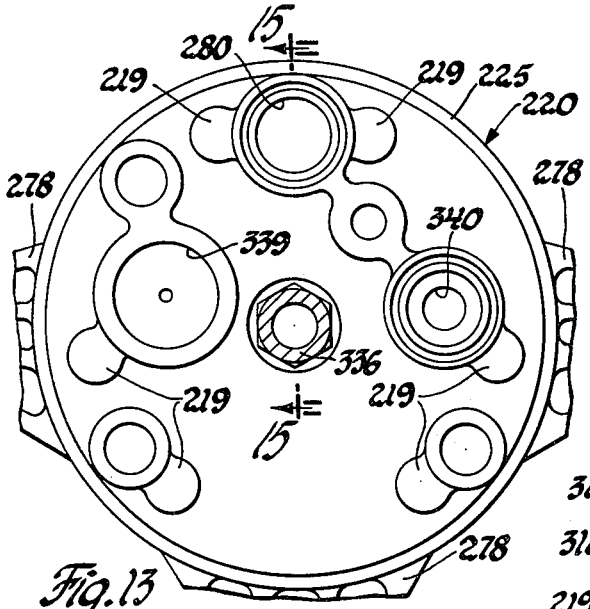
FIG. 13 is a view oriented like FIG. 9 and taken along the line 13—13 in FIG. 9.
Figure 14:
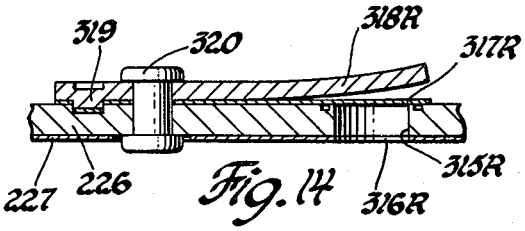
FIG. 14 is a view taken along the line 14—14 in FIG. 11.

The front and rear cylinder blocks 212 and 216 each have a cluster of three equally angularly and radially spaced and parallel thin-wall cylinders 232(F) and 232(R), respectively (the suffixes F and R being used herein to denote front and rear counterparts in the compressor). The thin-wall cylinders 232(F) and 232(R) in each cluster are integrally joined along their length with each other both at the center of their respective cylinder block 212 and 216 and at their respective cylinder block shell 14 and 18 as can be seen in FIGS. 9 and 10. The respective front and rear cylinders 232(F) and 232(R) each have a cylindrical bore 234(F) and 234(R) all of equal diameter and the bores in the two cylinder blocks are axially aligned with each other and closed at their outboard end by the respective front and rear valve disk 223 and 227 and valve plate 222 and 226. The cylinder blocks each have a hollow opening at their juncture such that oppositely facing inboard ends of the aligned cylinders 232(F) and 232(R) are axially spaced from each other and together with the remaining inboard end details of the cylinder blocks 212 and 216 and the interior of their respective integral shell 214 and 218 form a central swash plate accommodating crankcase cavity or space 35 in the compressor extending transversely thereacross to the internal periphery thereof as in the FIGS. 1–7 embodiment thereby fully exposing both sides of the swash plate. In what will be referred to as the normal or in-use orientation of the compressor, the three pair of aligned cylinders are located as seen in FIGS. 9 and 10 at or close to the two, six and ten o'clock positions with the two adjoining upper cylinders in each cylinder block designated 232(A) and 232(B) and the lowermost cylinder designated 232(C).

A symmetrical double-ended piston 236 of aluminum is reciprocally mounted in each pair of axially aligned cylinder bores 234(F), 234(R) with each piston having a short cylindrical front head 238(F) and a short cylindrical rear head 238(R) of equal diameter which slides in the respective front cylinder bore 234(F) and rear cylinder bore 234(R). The two heads 238(F) and 238(R) of each piston are joined by a bridge 239 spanning the cavity 235 but are absent any sled runners and instead are completely supported as well as sealed in each cylinder bore by a single solid (non-split) seal-support ring 240 mounted on each piston head with such piston structure and the support and sealing arrangement therefor the same as shown in the FIGS. 1–7 embodiment and as described in more detail later.

The three pistons 236 are driven in conventional manner by a rotary drive plate 241 located in the central cavity or space 235. The drive plate 241, commonly called a swash plate, drives the pistons from each side through a ball 242 which fits in a socket 244 on the backside of the respective piston head 238 and in a socket 246 in a slipper 248 which slidably engages the respective side of the swash plate. The swash plate 241 is fixed to and driven by a drive shaft 249 that is rotatably supported and axially contained on opposite sides of the swash plate in the two-piece cylinder block 212, 216 by a bearing arrangement including axially aligned front and rear needle-type journal bearings 250(F), 250(R) and front and rear needle-type thrust bearings 252(F), 252(R).

The front journal bearing 250(F) and rear journal bearing 250(R) are mounted respectively in a central bore 254 in the front cylinder block 212 and a central bore 256 in the rear cylinder block 216 and it is important that these bores, like the cylinder bores in the blocks, be closely aligned with each other. The front thrust bearing 252(F) and rear thrust bearing 252(R) are mounted respectively between an annular shoulder 258, 260 on the respective front and rear side of hub 262 of the swash plate 241 and an annular shoulder 264, 266 on the respective inboard end of the front and rear cylinder blocks 212, 216. The rear end 268 of the drive shaft 249 terminates within the rear cylinder block shaft bore 256 which is closed by the center of the rear valve plate 226. On the other hand, the drive shaft 249 extends outward of the front cylinder block shaft bore 254 through a central hole 270 in the front valve plate 222 and thence on outwardly through an aligned hole 271 in a tubular extension 272 which projects outwardly from and is integral with the front head 210.

As shown in FIG. 8, a rotary seal assembly 274, including a stationary seal 275 and a spring biased rotary seal 276 that engages therewith, provides sealing between the drive shaft 249 and front head 210 within the tubular extension 272. Outboard this seal arrangement the drive shaft 249 is adapted to be secured with the aid of a thread 277 on the end thereof to a clutch of conventional type, not shown, which is engageable to clutch the shaft to a pulley, also not shown, which is concentric therewith and in the case of vehicle installation is belt driven from the engine. For mounting the compressor, three mounting arms 278 are integrally formed with the front head 210.

The heads 238(F), 238(R) of the pistons 236 are extremely short and without sled runners and are provided with a diametrical dimension less than the diametrical dimension of their cylinder bores 234(F), 234(R) to provide a space therebetween enabling the seal-support ring 240 between each piston head and its respective bore to be made sufficiently thick so that it provides full radial support of the piston head within its cylinder bore as well as sealing with the metal of the piston head then not allowed to touch the metal of its respective cylinder bore throughout its reciprocation therein. See FIGS. 8 and 21–23. Each piston head 238(F), 238(R) is provided with a sufficiently short longitudinal or axial dimension along its bores so as to produce a sufficient circumscribing area on the piston head in juxtaposition with the bore to permit the wear resistance of the seal-support rings 240 to approximate the life of the compressor while the weight of the piston head is reduced. In addition, the pistons have essentially only sufficient material in their bridge 239 to hold the piston heads together during reciprocation so that the weight of the piston is further reduced. With such piston weight reduction, the mass of the swash plate 241 is then reduced by thinning thereof in proportion to such reduction in the piston while still providing dynamic balancing thereof. The above dimensional reductions in turn allow compacting of the compressor outline in the longitudinal or axial direction. For example, in an actual construction of the compressor disclosed herein (not including clutch) having a total displacement of about 164 $cm^3$, it was found that its barrel diameter and length could be made as small as about 117 mm and 160 mm respectively and its weight as little as about 3.6 kg.

The pistons' solid seal-support rings 240 are made of a slippery material such as Teflon or the like and are each mounted in a circumferential groove 370(F), 370(R) in the respective pistons heads 238(F), 238(R) of each piston 236. The piston seal-support rings 240 are provided with a nominal unstressed thickness dimension slightly greater than the width of the radial space between the piston head and its respective bore and are provided with a nominal unstressed longitudinal or axial dimension slightly less than the longitudinal or axial dimension of the piston head. The two remaining lands 372(F), 374(F) and 372(R), 374(R) on each of the respective piston heads 238(F), 238(R) that are on opposite sides of the seal-support ring 240 are extremely thin as permitted by their relief from side loading and thus each of the pistons 236 is free to tilt or angle slightly with respect to the paired-cylinder bores therefor. This reduces significantly the criticality of the axial alignment of these bores and thereby increases substantially their manufacturing tolerance further enabling individual boring of the front and rear cylinder blocks rather than as an assembled pair.

With the pistons 236 thus completely supported in their bores by the solid (non-split) seal-support rings 240, the pistons may then move axially and radially relative to their rings and also in a back and forth rolling sense about the piston's centerline. As to the relative axial movement, this results from end play between the ring and its groove which cannot normally be avoided except by selective fit because of manufacturing tolerances. As to the relative radial movement, this results from the drive engagement between the pistons and the swash plate. As to the relative rolling movement, this results from the clearance between the bridge 239 of the pistons and the periphery of the swash plate 241 as can be seen in FIGS. 8 and 10. This relative piston groove and seal-support ring movement or rubbing can wear the ring groove deeper thereby adversely affecting sealing as well as wear the flat annular face of the groove shoulders at the piston head lands 372 and 374 thereby adversely affecting ring retention and thus again sealing. Such problems are positively avoided by manufacturing (as by cutting) the rings 240 in the shape of a slightly concave washer as shown in FIGS. 21 and 22 and to a certain size in relation to the diameter of the cylinder bores and the bottom of the piston ring grooves and by forming radially outwardly extending projections on the bottom of the ring grooves that will then positively interfere with relative ring and piston movement in both the longitudinal and roll direction. As to the formation of suitable projections on the bottom of the ring grooves this is accomplished by simply knurling or stenciling the bottom of each groove 370 so as to form a series of raised X's or crossbars 376 spaced thereabout with the raised bars or ridges of each at opposite angles to the pistons' longitudinal direction or centerline. The inner diameter (I.D.) of the rings 240 in the asmanufactured-state (washer shape) is made sufficiently small so as to pass with the concave side first over the end land 372 of the piston head with the ring under elastic stress across substantially the entire width thereof (see FIG. 21). This provides each ring with an expanded fit over the end lands 372 across substantially its entire width after which the ring contracts within the piston ring groove 370 with its opposite annular sides or faces 240(A) and 240(B) then assuming inner and outer cylindrical surfaces and with substantial radial pressure existing between the bottom of the piston ring groove 370 and the opposing inner cylindrical side or face 240(B) of the ring. With such rings 240 thus assembled on a piston 236, the rings are then radially inwardly compressed such as by passing such piston and ring assembly through a cone so that their outer diameter at side 240(B) is reduced to a dimension equal to or slightly less than the diameter of the cylinder bores 234. The piston 236 with the thus squeezed rings 240 thereon is assembled in its cylindrical bores 234(F), 234(R) before the memory of the ring material causes the rings to recover to their original thickness. Then with their memory recovering in the cylinder bores, the rings 240 thereby expand to effect tight sealing engagement therewith as well as prevent relative radial movement between the annular shoulders of the piston ring grooves 370 and the annular edges of the rings in support of the piston head in its cylinder bore. In addition, this piston ring groove and ring relationship and assembly in the cylinder bores causes the raised projections 376 on the bottom of each piston ring groove 370 to bite or imbed into the inner cylindrical face 240(B) of the rings 240 mounted thereon under the contractural force of the ring and the retained compression thereof by its respective cylinder bore. This bite or imbedment is determined to a degree sufficient to anchor the piston against both rotational and longitudinal sliding movement relative to the ring and be maintained by the radial containment of the ring by the cylinder bore in which it slides. Thus, the pistons 236 and their rings 240 are positively prevented from rotating or sliding relative to each other and thereby causing rubbing wear therebetween. For example, in an actual construction of the compressor disclosed herein, it was found that the above improved results were obtained with cylinder bores of about 38.1 mm when the piston ring groove bottom diameter $D_{170}$ and land diameter $D_{172,174}$ were made about 36.6 mm and 37.9 mm, respectively, the projections 376 were provided with a heighth of 0.05–0.10 mm max., and the seal-support rings 240 in the preassembly state (washer shape) was then provided with a thickness of about 5.8 mm and an inner and outer diameter of about 28.5 mm and 40.1 mm, respectively.

Figure 15:
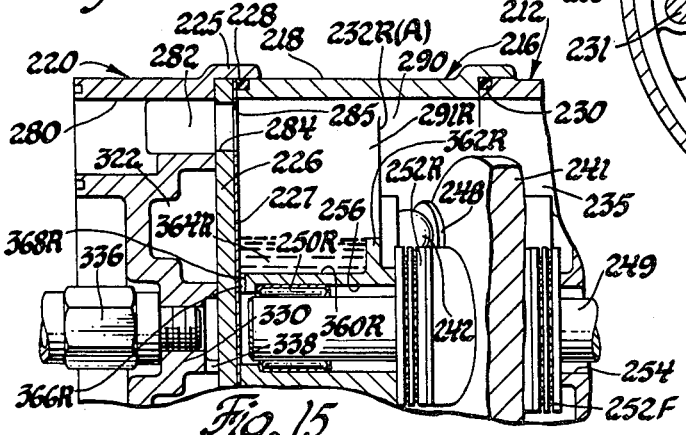
FIG. 15 is a view taken along the line 15—15 in FIG. 13.
Figure 16:
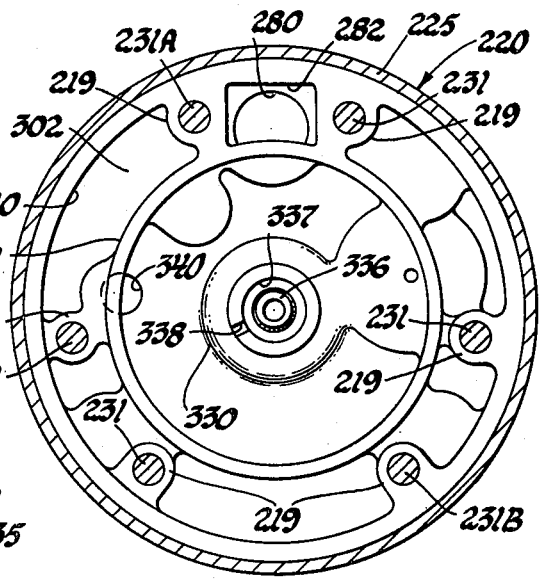
FIG. 16 is a view oriented like FIG. 9 and taken along the line 16—16 in FIG. 8.
Figure 17:
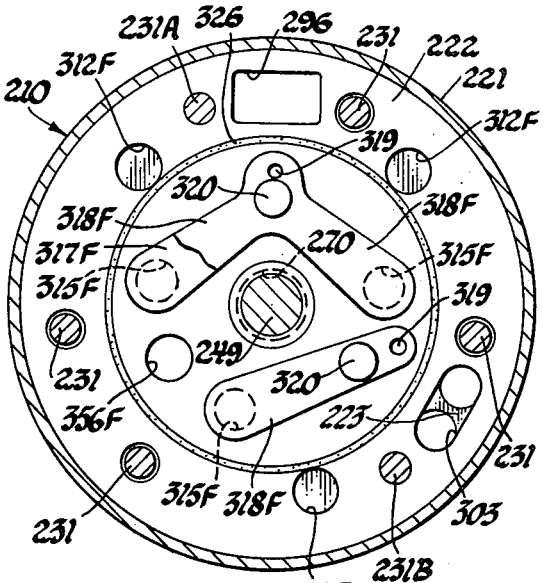
FIG. 17 is a view oriented like FIG. 9 and taken along the line 17—17 in FIG. 8.
Figure 18:
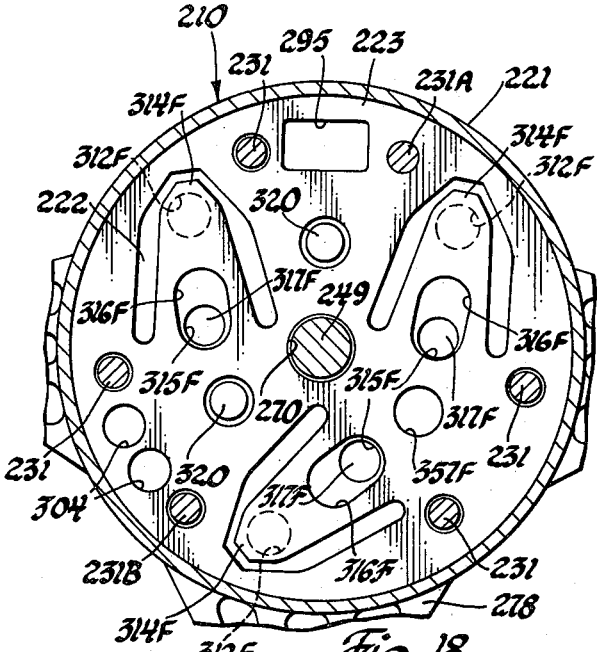
FIG. 18 is a view oriented like FIG. 9 and taken along the line 18—18 in FIG. 8.
Figure 19:
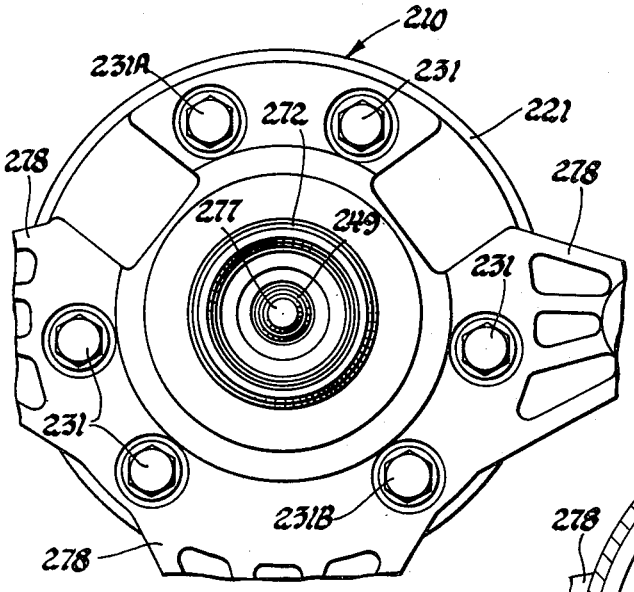
FIG. 19 is a view oriented like FIG. 9 and taken along the line 19—19 in FIG. 8.
Figure 20:
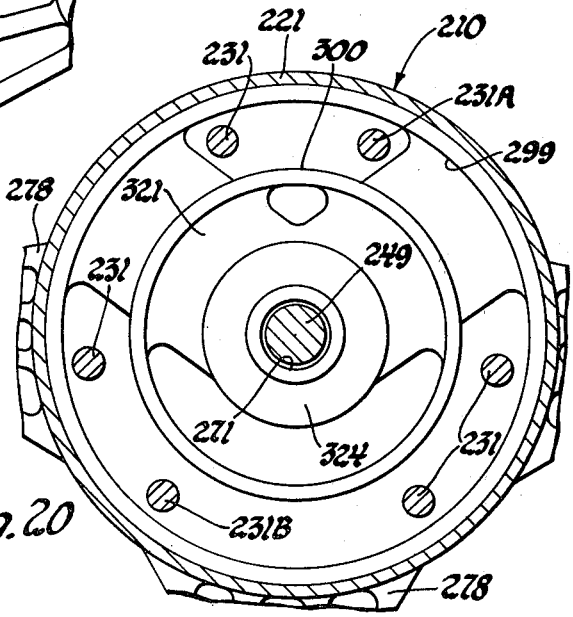
FIG. 20 is a view oriented like FIG. 9 and taken along the line 20—20 in FIG. 8.

Describing now the refrigerant flow system within the compressor in FIGS. 8–23, gaseous refrigerant with some oil entrained therein enters through an inlet 280 in the rear head 220 and into a cavity 282 in the rear head as can be seen in FIGS. 15 and 16. The entering refrigerant is directed through the rear cavity 282 through a rectangular shaped aperture 284 in the rear valve plate 226 and a corresponding aperture 285 in the rear valve disk 227 into a refrigerant transfer and oil separation cavity arrangement or suction passage 290 which extends the length of the two-piece cylinder block 212, 216 and opens intermediate its length to the central crankcase cavity or space 235 accommodating the swash plate 241 as in the FIGS. 1–7 embodiment. The longitudinally extending refrigerant transfer and oil separation passage 290 is defined again by certain internal structure of the compressor so as to induce oil separation from the passing refrigerant for lubrication of the compressor's working parts. This oil separation structure primarily includes the adjoining longitudinally extending outer convex surface 291(F), 292(F) and 291(R), 292(R) of the two adjoining upper cylinder walls 232(A), 232(B) of the respective front and rear cylinder blocks 212, 216 and by, but only secondarily, the longitudinally extending interior concave surface 294(F), 294(R) of the respective front and rear cylinder block shells 214, 218.

The refrigerant transfer and oil separation passage 290 is open in the front end of the compressor through a rectangular shaped aperture 295 in the front valve disk 223 and a corresponding aperture 296 in the front valve plate 222 to an annular front suction chamber 298 in the front head 210 located around the internal periphery thereof as in the FIGS. 1–7 embodiment. The front suction chamber 298 is formed by the inboard side of the front head 210 and an external and internal cylindrical wall 299, 300, respectively, extending inboard therefrom and by the outboard side of the front valve plate 222. The front suction chamber 298 is connected to a crossover suction passage 301 extending longitudinally within the compressor between the cylinder walls 232(A) and 232(C) as is a rear suction chamber 302 in the rear head 220 like in the FIGS. 1–7 embodiment. The front suction chamber 298 is open to the crossover suction passage 301 through an oblong aperture 303 in the front valve plate 222 (see FIGS. 17 and 23) and a pair of circular apertures 304 in the front valve disk 323 (see FIGS. 18 and 23). The suction crossover passage 301 extends the length of the two-piece cylinder block 212, 216 and opens intermediate its length to the swash plate accommodating space 235 across the swash plate from the opening thereto of the refrigerant transfer and oil separation passage 290 as in the FIGS. 1–7 embodiment and is formed by the adjoining longitudinally extending outer convex surface 305(F), 306(F) and 305(R), 306(R) of the two adjoining cylinder walls 232(A), 232(C) of the respective front and rear cylinder blocks 212, 216 and by the longitudinally extending interior concave surface 307(F), 307(R) of the respective cylinder block shells 218, 214. The crossover suction passage 301 at the rear end of the compressor is open to the rear suction chamber 302 through a pair of circular apertures 308 in the rear valve disk 227 (see FIGS. 12 and 23) and an oblong aperture 309 in the rear valve plate 226 (see FIGS. 11 and 23). The two suction chambers 298 and 302 are additionally connected to the swash plate accommodating space 235 and thereby to the refrigerant transfer and oil separation passage 290 by another crossover suction passageway extending between the cylinders as in the FIGS. 1–7 embodiment as will be described in more detail later. As can be seen in FIGS. 8, 15 and 16, the rear section chamber 302 is located around the internal periphery of the rear head as in the FIGS. 1–7 embodiment and is a partial or split annulus by separation of the inlet cavity 282 and is formed by the inboard side of the rear head 220 and an external and internal partial cylindrical wall 310, 311, respectively, extending inboard therefrom and by the outboard side of the rear valve plate 226.

The refrigerant received in the respective front and rear suction chamber 298, 302 which is primarily from the crankcase cavity 235 is admitted to the piston head end of the respective cylinder bores 234(F), 234(R) through separate suction ports 312(F), 312(R) in the respective front and rear valve plates 222, 227 (see FIGS. 11, 12, 17, 18 and 23). Opening of the suction ports 312(F), 312(R) during the respective piston suction stroke and closing during the piston discharge stroke is effected by separate reed-type suction valve 314(F), 314(R) on the piston side of the valve plates which are formed in the front valve disks 223 and rear valve disk 227 respectively (see FIGS. 12 and 18).

Then for discharge of the refrigerant upon compression therof in the cylinders, there are formed separate discharge ports 315(F), 315(R) in the respective valve plates 222, 226 with these discharge ports located at the piston end of the respective cylinder bores 234(F), 234(R) and open thereto through oblong apertures 316(F), 316(R) in the respective valve disks 223, 227 (see FIGS. 11, 12, and 17, 18). Opening and closing of the respective discharge ports 315(F), 315(R) is effected by separate reed-type discharge valves 317(F), 317(R) of spring steel which are backed up by rigid retainers 318(F), 318(R). The discharge valves 317(F), 317(R) and their respective retainers 318(F), 318(R) are each fixed as seen in FIGS. 11, 14, 17 and 23 by an integral pin and blind hole interlock 319 and a rivet 320 to the outboard side of the front valve plate 222 and rear valve plate 226 respectively and it will be noted that the discharge valves and retainers for the two upper cylinders in each cylinder block are of siamesed construction.

The respective discharge ports 315(F), 315(R) are opened by their discharge valves 317(F), 317(R) to an annular discharge chamber 320, 322 in the respective front and rear heads 210 and 220. The front discharge chamber 320 is formed by the inboard side of the front head 210 and the interior cylindrical wall 300 and an inboard projecting extension 324 of the tubular portion 272 of the front head and by the outboard side of the front valve plate 222. The inwardly projecting annular extension 324 on the front head 210 engages and thereby braces the center of the front valve plate 222 about the drive shaft 249. An O-ring seal 326 is mounted in a circular groove in the outboard side of the front valve plate 222 and is engaged by the flat annular radial face of the interior cylindrical wall 300 of the front head to provide sealing between the front suction chamber 298 and front discharge chamber 320. At the opposite or rear end of the compressor, the rear discharge chamber 322 is formed by the inboard side of the rear head 220, the interior cylindrical wall 311 of the rear head and a central boss 330 extending from the inboard side of the rear head and by the outboard side of the rear valve plate 226. An O-ring seal 332 is mounted in a circular groove in the outboard side of the rear valve plate and is engaged by the flat annular radial face of the interior wall 311 of the rear head to provide sealing between the rear suction chamber 302 and rear discharge chamber 322. The central boss 330 engages and thereby braces the center of the rear valve plate 226 and in addition has a conventional high pressure relief valve 336 threaded thereto. The relief valve 336 is open to the discharge chamber 322 through a central axial bore 337 and a radial port 338 in the boss 330 to provide high pressure relief operation. In addition, there is formed a port 339 in the rear head 220 that is open to the rear discharge chamber 322 and is adapted to receive a conventional pressure switch, not shown.

The discharge chambers 320 and 322 in the opposite ends of the compressor are connected to deliver the compressed refrigerant in a pulse attenuated state to an outlet 340 in the rear head 220 which opens directly to the rear discharge chamber 322. This pulse attenuated state is accomplished by connection of the two discharge chambers 320, 322 through two large volume attenuation chambers 348 and 350 which are formed in the outboard end of the respective cylinder blocks 212 and 216 between their cylinder walls 232(B) and 232(C) and are interconnected by a long, small-flow-area attenuation passage 352 formed by a matching bore 354(F), 354(R) in these respective cylinder blocks (see FIGS. 8–12, 17, 18 and 23). As best seen in FIGS. 8–10 and 23, two radially and longitudinally extending partitions 350(F) (B), 355 (F) (C) and 355(R) (B), 355 (R) (C) in the respective front and rear cylinder blocks 212, 216 together with the respective integral shells 214 and 218 define the peripheral wall of the respective attenuation chambers 348, 350. These partitions separate the chambers 348 and 350 from the two bolts 231 which extend with clearance through the remaining cavities in the cylinder blocks between their cylinder walls 232(B) and 232(C) and through their accommodating holes in the valve plates and valve disks to thereby form addition longitudinally extending crossover suction passages 301(B) and 301(C) connecting the suction chambers 298 and 302 with the suction passage 290 via the swash plate accommodating space 235. Connection is then provided directly between the discharge chambers 320, 322 and the respective attenuation chambers 348, 350 by a transfer port 356(F), 356(R) in the respective valve plates 222, 226 and a corresponding aperture 357(F), 357(R) in the respective valve disks 223, 227 (see FIGS. 11, 12 and 17, 18). As a result, the discharge gas pulses from each of the cylinders at the opposite ends of the compressor first experience a large chamber (i.e. their respective discharge chamber 320 or 322) and are then permitted to be transmitted in restricted manner through a small port (i.e. port 356(F) or 356(R)) to a first attenuation chamber (i.e. chamber 348 or 350) and thereafter through a long passage of restricted size (i.e. passage 352) and thence into a second attenuation chamber (i.e. chamber 350 or 348) and eventually to the other discharge chamber (i.e. discharge chamber 322 or 320). The three discharge pulses emitted from the cylinders at each end of the compressor are out of phase with each other but in phase with those at the opposite end and it has been found that by prescribing a certain relationship between the volume and length of the attenuation chambers and the flow area and length of the passage connecting them, the above internal gas discharge network in the compressor operates to substantially attenuate the gas pulses issuing from the compressor at the outlet 340 to the extent that no external or auxiliary muffler is required. For example, in an actual construction of the compressor disclosed herein having a total displacement of about 164 $cm^3$, it was found that with the volume and length of each attenuation chamber 348, 350 made about 12.3 $cm^3$ and 30 mm respectively, and the flow area and length of the connecting attenuation passage 352 made about 40 $mm^3$ and 49 mm, respectively, no objectionable vibrations were observed at a conventional condenser and/or evaporator served by the compressor.

The attenuation bores 354(F), 354(R) which align with each other to form the passage 352 interconnecting the attenuation chambers 348 and 350 also contribute significantly in simplifying the manufacture of the two cylinder blocks 212 and 216 by permitting their processing as separate pieces on an assembly line rather than perfecting marriage between two particular cylinder blocks and having to then process both on down the line. This is accomplished by first locating and boring the bore 354(F), 354(R) in each cylinder block on the assembly line and then locating off this bore at the various work stations, such as with a locator pin, for all further processing of this part. As a result, it is possible to accurately locate and then machine the cylinder and shaft bores and other critical details in each cylinder block piece with automatic equipment so that they have the required close alignment with their counterpart(s) or other associated structural details in any other cylinder block piece. This accurate cylinder block alignment is then positively established and maintained at final assembly by two of the six bolts 231 designated as 231(A) and 231(B) which are located generally opposite each other relative to the compressor centerline. The two bolts 231(A) and 231(B) are the only bolts that are required to fit, and closely so, with matching holes 358(F), 358(R) and 359(F), 359(R) that are accurately located off of the respective locator bores 354(F), 354(R) and bored in internal bosses in the respective cylinder blocks 212 and 216 (see FIGS. 9, 10 and 23).

The compressor in FIGS. 8–23 has no oil lubricating pump mechanism as such and instead has a passive lubrication system as in the FIGS. 1–7 embodiment which separates out and strategically deploys the oil entrained in the entering refrigerant to lubricate all of the compressor's internal sliding and bearing surfaces. Describing then and comparing the two embodiments of the present invention they each provide for lubrication of a compressor having a swash plate 18 (241) that is rotatably supported and axially contained between a pair of end-to-end joined cylinder blocks 28, 30 (212, 216) by a journal bearing 22, 25 (250 F, R) and a thrust bearing 40, 42 (252 F, R) on opposite sides of the swash plate wherein the swash plate sides 39 are in sliding drive engagement with pistons 31, 32, 33 (236) mounted in cylinders 33 (232) in the cylinder blocks and wherein a cylinder head 14, 16 (210, 220) having a suction chamber 56, 58 (298, 302) is located opposite an outer end of each cylinder block. Morover, the compressor each have at least one suction passage 78 or 79 (302 or 301 B, C) extending longitudinally therein between adjacent cylinders in each cylinder block that directly connects a suction inlet 70 (280) in the compressor receiving gaseous refrigerant and entrained oil to both suction chambers while also exposing one portion of the swash plate sides between such adjacent cylinders. Furthermore, the gaseous refrigerant and entrained oil from the suction inlet flows past the one portion of the swash plate sides with oil thereby separating and depositing thereon, and at least some of the gaseous refrigerant and entrained oil from the suction inlet flows through a cavity or passage 77 (290) above each journal bearing defined by the walls 102, 104 (291, 292) of adjacent cylinders in each cylinder block and in such heat exchange relation with such walls that some entrained oil is then separated out by the heat of such walls and delivered by gravity to the journal bearing and thrust bearing on the respective swash plate sides with some of the oil thus separated then flung from the thrust bearings onto the respective swash plate sides.

According to the present invention, improved lubrication as well as weight reduction is accomplished by the suction chamber 56, 58 (298, 302) of each cylinder head being located around the internal periphery thereof, the cavity 77 (290) of each cylinder block being located adjacent the periphery of the compressor, the suction inlet 70 (280) being located in one of the cylinder heads in longitudinal alignment with the cavities 77 (290), the longitudinally extending suction 78 or 79 (301 or 301 B, C) being located adjacent the periphery of the compressor across the compressor and the swash plate sides remote from the suction inlet, and the cylinder blocks each having a hollow opening 92, 94 (235) at their juncture which together form within the compressor an accommodating space for the swash plate open directly to the cavities and the longitudinally extending suction passage, and in addition form a transversely extending suction passage extending to the internal periphery of the compressor and along both sides of the swash plate and across the axis thereof connecting the suction inlet to the longitudinally extending suction passage whereby the weight of the cylinder blocks is substantially reduced and in addition the sliding drive surfaces of both sides of the swash plate are directly exposed to and completely enveloped by gaseous refrigerant and entrained oil as it flows from the suction inlet to the longitudinally extending suction passage thereby to ensure that sufficient entrained oil is caused to separate out as a film on the swash plate sides. Moreover, the longitudinally extending suction passage is defined as a hollow by walls just sufficiently thick to form adjacent cylinders in each cylinder block whereby the weight of the cylinder blocks is substantially further reduced. In addition, the cavities are defined as a hollow by walls just sufficiently thick to form adjacent cylinders in each cylinder block whereby the weight of the cylinder blocks is substantially further reduced.

As further disclosed in the FIGS. 8–23 embodiment, but not a part of the present invention claimed herein, a dam 362(F), 362(R) is formed integral with the two upper cylinder walls 232(A) and 232(B) in each cylinder block across the respective valley 360(F), 360(R) at its inboard end so as to form an oil catch basin 364(F) and 364(R) in the respective front and rear cylinder block that is elevated directly above the respective front and rear journal bearing 250(F) and 250(R) when the compressor is mounted in its normal position or any position rotated in either direction therefrom in a range of ±45° about the compressor centerline. The oil catch basins 364(F), 36(R) are connected to drain to the respective journal bearings 250(F), 250(R) by a vertical passage 366(F), 366(R) respectively, these oil passages being formed by a vertical radial groove 368(F), 368(R) in the outboard face of the respective cylinder blocks 212, 216 such that the oil is permitted to drain straight down along the inboard side of the respective valve disks 223, 227 and into the respective shaft accommodating bores 254, 256 and thence directly to the outboard end of the respective journal bearings 250(F), 250(R).

Thus, oil is caught in the oil catch basins 364(F), 364(R) during compressor operation and is delivered during continued operation first to the respective journal bearings 250(F), 250(R) and thence delivered inboard through the respective bores 254, 256 and along the drive shaft 249 to the thrust bearings 252(F), 252(R) from which such oil is eventually flung outward there-through and onto the opposite sides of the swash plate 241 to lubricate the ball and slipper drive connections with the pistons 236. Furthermore, the oil catch basins 364(F), 364(R) also serve to retain a portion of the oil caught therein during compressor operation for use after each intermittent stop as normally occurs in the operation of the compressor in vehicle use so that oil is immediately available to be delivered to the bearings in the same sequence each time compressor operation is restarted. Thus, continuous oil wetting of all the bearings is assured during intermittent compressor operation.

While the above disclosed embodiments constitute alternative forms of the present invention, it will be understood by those skilled in the art that other forms may be adopted within the scope of the appended claims.

The embodiments of the invention in which an exclusive property or privilege is claimed are defined as follows:

1. A swash plate compressor, comprising: a cylindrical shell surrounding front and rear cylinder heads disposed at opposite ends of said shell, said rear cylinder head having a suction inlet and a discharge outlet, a cylinder block disposed intermediate said heads within said shell, said cylinder block including three longitudinally disposed tubular portions arranged about the shell axis and configured to provide open space between adjacent pairs of said tubular portions to reduce the weight of said cylinder block and with an upper two of the tubular portions above the third to form with said shell a low pressure gas upper inlet channel and a pair of low pressure gas lower exit channels, said tubular portions defining front and rear cylinder bores on opposite sides of an inwardly-facing notched-out opening and front and rear hubs respectively, between said front and rear cylinder bores and in communication with said upper inlet channel, whereby to define by said notched-out opening a location for a swash-plate and by said hubs a location for journal means, journal means in said hubs, a compressor drive shaft rotatably supported by said journal means; a swash plate rotatable by said drive shaft in said location for a swash plate, piston means arranged to reciprocate within said cylinder bores in response to rotation of said swash plate, front and rear thrust bearings in said location for a swash plate between each hub and said swash plate so as to restrict endwise movement of said shaft, front and rear valve plates respectively interposed between said cylinder block and said front and rear cylinder heads, each of said front and rear valve plates having inlet and outlet ports therein communicating with associated front and rear cylinder bores, each of said front and rear cylinder heads configured to define with their respective front and rear valve plates an outer low pressure gas suction chamber opposite the open space of said tubular portions and an inner high pressure gas discharge chamber, cross-over passage means interconnecting the inner high pressure gas discharge chambers of said front and rear cylinder heads, means in said rear head and its associated valve plate providing direct axial flow communication from said suction inlet to said upper inlet channel for receiving a mixture of low pressure gas and oil into said upper inlet channel, means in said front and rear heads and their associated valve plates providing axial flow communication from said upper inlet channel to said outer low pressure gas suction chambers via said location for a swash plate and each of said lower exit channels for introduction of a low pressure gas and oil mixture into said cylinder bores, whereby low pressure gas and oil mixture, upon entering said upper inlet channel, flows in heat exchange relation with said upper two of the tubular portions to increase the temperature of said mixture sufficiently to separate a portion of the oil from the gas and deposit the oil portion by gravity on said upper two of the tubular portions for subsequent gravitational flow to the journal means in said hubs by way of the communication of said inlet channel with said hubs to lubricate said front and rear journal means and thrust bearings, and whereby the oil remaining in said mixture after said separation is caused by the flow of said gas to exit said upper inlet channel via the location for said swash plate so that sufficient of the remaining oil admixed with said gas impinges upon and wets the surfaces of said swash plate to lubricate same during reciprocation of said piston means.

2. A swash plate compressor, comprising: a cylindrical shell, front and rear cylinder heads disposed at opposite ends of said shell, said rear cylinder head having a suction inlet line and a discharge outlet line, cylinder block means disposed intermediate said heads in said shell, said cylinder block means including three longitudinally disposed tubular portions joined to each other to form integral hub means about the shell axis but spaced from each other between the hub means and the cylindrical shell to reduce the weight of said cylinder block means, each said tubular portion defining a pair of aligned front and rear cylinder bores disposed at either end thereof, each tubular portion having its pair of front and rear cylinder bores axially separated by a radially inwardly-facing notched-out opening, said hub means including front and rear hubs aligned on said shell axis on opposite sides of said notched-out opening to define a central swash plate space, a pair of said tubular portions disposed in a common horizontal upper plane located above said shell axis, the third tubular portion disposed in a lower horizontal plane below said shell axis, a compressor drive shaft rotatably supported by front and rear journal means in said front and rear hubs, respectively; a swash plate rotatable by said drive shaft in said swash plate space, said pair of upper tubular portions defining with said shell a low pressure refrigerant gas upper inlet channel, said pair of upper tubular portions defining with said third lower tubular portion and said shell a pair of low pressure refrigerant gas lower exit channels, piston means arranged to reciprocate within the aligned cylinder bores of each tubular portion whereby rotation of said swash plate imparts reciprocation to said piston means, front and rear thrust bearing means between each hub and said swash plate so as to restrict endwise movement of said shaft, front and rear valve plate means interposed between the front and rear faces of said cylinder block means and said cylinder heads, each said front and rear valve plate means having inlet and outlet ports therein for each of its associated front and rear cylinder bores, each said front and rear cylinder head having a peripheral rib and an intermediate closed rib, the front and rear head ribs defining with their respective front and rear valve plate means an outer low pressure refrigerant gas suction chamber opposite the cylinder block means where the tubular portions are spaced from each other and an inner high pressure refrigerant gas discharge chamber, crossover passage means interconnecting said front and rear head discharge chambers, means forming aligned inlet passages in said rear head and its associated valve plate means providing aligned axial flow communication with said upper inlet channel, wherein the total flow of low pressure refrigerant gas from said inlet line containing a substantial amount of oil enters said upper channel, said rear head discharge chamber being in communication with said outlet line, outlet means in each said front and rear valve plate means alinged with each said lower exit channel, such that low pressure refrigerant gas flows from said swash plate space via each said lower exit channel to both front and rear head outer suction chambers for introduction into the front and rear cylinder bores, whereby the low pressure refrigerant gas and oil admixed therewith, upon entering the rearward end of said upper inlet channel, is conveyed axially in heat exchange relation over said pair of upper tubular portions increasing the temperature of the refrigerant gas causing a portion of the entrained oil to separate from the refrigerant gas and deposit by gravity on said upper pair of tubular portions for subsequent gravitational flow downwardly to lubricate said front and rear journal means and thrust bearing means, and whereby the total flow of low pressure refrigerant gas is caused to exit said upper inlet channel via the swash plate central space prior to being conveyed into said lower exit channels causing sufficient of the remaining oil admixed therewith to impinge upon and wet the surfaces of said swash plate to lubricate same during reciprocation of said piston means.

3. A lightweight swash plate compressor comprising: a cylindrical shell surrounding front and rear cylinder heads disposed at opposite ends of said shell, said cylindrical shell forming a crankcase and said cylinder heads partially forming a pair of radially outer suction chambers and a pair of radially inner discharge chambers flanking said crankcase, a trifurcated cylinder block disposed intermediate said cylinder heads within said shell and said crankcase, said cylinder block including three tubular portions arranged about an axis to provide open space between adjacent pairs of said tubular portions, thereby to reduce the weight of said cylinder block, the tubular portions forming with said shell a low pressure gas inlet channel to said crankcase and a pair of low pressure gas exit channels respectively to said pair of suction chambers, said tubular portions defining three front and three rear cylinder bores on opposite sides of an inwardly-facing notched-out opening and front and rear hubs respectively interconnecting said three front cylinder bores and said three rear cylinder bores adjacent their respective discharge chambers, whereby to define by said notched-out opening a location for a swash plate and by said hubs a location for journal means, journal means in said hubs, a compressor drive shaft rotatably supported by said journal means; a swash plate rotatable by said drive shaft in said location for a swash plate, piston means arranged to reciprocate within said cylinder bores in response to rotation of said swash plate, front and rear valve plates respectively interposed between said cylinder block and said cylinder heads, said valve plates being supported by said hubs and said tubular portion adjacent said discharge chamber but unsupported by the open space between adjacent pairs of said tubular portions adjacent said suction chambers, each of said front and rear valve plates having inlet and outlet ports therein communicating with associated front and rear cylinder bores, said front and rear valve plates cooperating respectively with said front and rear cylinder heads to define therewith said radially outer suction cavities where said valve plates are unsupported and said radially inner discharge chambers where said valve plates are supported, means forming a suction inlet to said open space, means interconnecting the radially inner discharge chambers and forming a discharge outlet therefrom, whereby low pressure suction gas is exposed to the unsupported portions of said valve plates and high pressure discharge gas is exposed to the supported portions of said valve plates whenever the piston means are being reciprocated within said cylinder bores in response to rotation of said swash plate.

4. A lightweight swash plate compressor comprising: a cylindrical shell surrounding a cylinder head disposed at one end of said shell, closure means at the other end of said shell, said cylindrical shell forming a crankcase and said cylinder head partially forming a radially outer suction cavity and a radially inner discharge cavity, a trifurcated cylinder block disposed intermediate said cylinder head and said other end closure means within said shell and said crankcase, said cylinder block including three tubular portions arranged about an axis to provide open space between adjacent pairs of said tubular portions, thereby to reduce the weight of said cylinder block, the tubular portions forming with said shell a low pressure gas inlet channel to said crankcase and a pair of low pressure gas exit channels to said suction cavity, said tubular portions defining three cylinder bores on one side of an inwardly-facing notched-out opening and a hub interconnecting said three cylinder bores adjacent their discharge cavity, whereby to define by said notched-out opening a location for journal means, journal means in said hub and said other end closure means, a compressor drive shaft rotatably supported by said journal means; a swash plate rotatable by said drive shaft in said location for a swash plate, piston means arranged to reciprocate within said cylinder bores in response to rotation of said swash plate, a valve plate interposed between said cylinder block and said cylinder head, said valve plate being supported by said hub and said tubular portion adjacent said discharge cavity but unsupported by the open space between adjacent pairs of said tubular portions adjacent said suction cavity, said valve plate having inlet and outlet ports therein communicating with associated cylinder bores, said valve plate cooperating with said cylinder head to define therewith said radially outer suction cavity where said valve plate is unsupported and said radially inner discharge cavity where said valve plate is supported, means forming a suction inlet to said open space, means interconnecting the radially inner discharge cavity and forming a discharge outlet therefrom, whereby low pressure suction gas is exposed to the unsupported portions of said valve plate and high pressure discharge gas is exposed to the supported portions of said valve plate whenever the piston means are being reciprocated within said cylinder bores in response to rotation of said swash plate.

5. In an axial-piston swash plate refrigerant compressor of the type having a swash plate that is rotatably supported and axially contained between a pair of end-to-end joined cylinder blocks by a journal bearing and a thrust bearing on opposite sides of the swash plate and wherein the swash plate sides are in sliding drive engagement with pistons mounted in cylinders in the cylinder blocks and wherein a cylinder head having a suction chamber is located opposite an outer end of each cylinder block and wherein at least one suction passage extends longitudinally within the compressor between adjacent cylinders in each cylinder block and directly connects a suction inlet in the compressor receiving gaseous refrigerant and entrained oil to both suction chambers while also exposing one portion of the swash plate sides between such adjacent cylinders, and wherein the gaseous refrigerant and entrained oil from the suction inlet flows past the one portion of the swash plate sides with oil thereby separating and depositing thereon, and wherein at least some of the gaseous refrigerant and entrained oil from the suction inlet flows through a cavity or passage above each journal bearing defined by the walls of adjacent cylinders in each cylinder block and in such heat exchange relation with such walls that some entrained oil is then separated out by the heat of such walls and delivered by gravity to the journal bearing and thrust bearing on the respective swash plate sides with some of the oil thus separated then flung from the thrust bearings onto the respective swash plate sides, characterized in that the suction chamber of each cylinder head is located around the internal periphery thereof, the cavity of each cylinder block is located adjacent the periphery of the compressor, the suction inlet is located in one of the cylinder heads in longitudinal alignment with said cavities, the longitudinally extending suction passage is located adjacent the periphery of the compressor across the compressor and the swash plate sides remote from the suction inlet, and the cylinder blocks each have a hollow opening at their juncture which together form within the compressor an accommodating space for the swash plate open directly to the cavities and the longitudinally extending suction passage, and in addition form a transversely extending suction passage extending to the internal periphery of the compressor and along both sides of the swash plate and across the axis thereof connecting the suction inlet to the longitudinally extending suction passage whereby the weight of the cylinder blocks is substantially reduced and in addition the sliding drive surfaces of both sides of the swash plate are directly exposed to and completely enveloped by gaseous refrigerant and entrained oil as it flows from the suction inlet to the longitudinally extending suction passage thereby to ensure that sufficient entrained oil is caused to separate out as a film on the swash plate sides.

6. An axial-piston swash plate compressor according to claim 5, characterized in that the longitudinally extending suction passage is defined as a hollow by walls just sufficiently thick to form adjacent cylinders in each cylinder block whereby the weight of the cylinder blocks is substantially further reduced.

7. An axial-piston swash plate compressor according to claim 5 or 6, characterized in that the cavities are defined as a hollow by walls just sufficiently thick to form adjacent cylinders in each cylinder block whereby the weight of the cylinder blocks is substantially further reduced.

* * * * *